US010161579B2

(12) United States Patent
Sorensen et al.

(10) Patent No.: US 10,161,579 B2
(45) Date of Patent: Dec. 25, 2018

(54) LED LIGHT PANEL AND METHOD OF INSTALLATION

(71) Applicant: Litetronics International, Inc., Bedford Park, IL (US)

(72) Inventors: Robert Sorensen, Bedford Park, IL (US); Raghu Rao, Romeoville, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days.

(21) Appl. No.: 15/590,553

(22) Filed: May 9, 2017

(65) Prior Publication Data

US 2018/0156399 A1 Jun. 7, 2018

Related U.S. Application Data

(63) Continuation-in-part of application No. 15/368,541, filed on Dec. 2, 2016, now Pat. No. 9,671,095.

(51) Int. Cl.

| | |
|---|---|
| ***F21S 8/02*** | (2006.01) |
| ***F21V 19/00*** | (2006.01) |
| ***F21V 19/04*** | (2006.01) |
| ***F21V 23/00*** | (2015.01) |
| ***F21Y 115/10*** | (2016.01) |

(52) U.S. Cl.

CPC ..... *F21S 8/026* (2013.01); *F21V 19/001* (2013.01); *F21V 23/003* (2013.01); *F21V 19/04* (2013.01); *F21Y 2115/10* (2016.08)

(58) Field of Classification Search

CPC .. E04B 9/08; E04B 9/006; E04B 9/205; F21S 8/026; F21V 21/048; F21V 23/003; F21V 21/046; F21V 21/30

See application file for complete search history.

(56) References Cited

U.S. PATENT DOCUMENTS 2,852,663 A * 9/1958 Stuffer ..... F21V 17/101 292/145
2,961,530 A * 11/1960 Garnett ..... F21S 8/02 362/311.03
3,019,333 A * 1/1962 Pascucci ..... F21S 8/02 220/3.8
3,303,338 A * 2/1967 Lyon ..... F21S 8/02 362/148
3,308,288 A * 3/1967 Ades ..... E04B 9/006 362/150
3,545,145 A * 12/1970 Yousefpor ..... E04B 9/003 362/150
3,810,085 A * 5/1974 Woloski ..... F21S 8/02 362/277
3,816,880 A * 6/1974 Jacobs ..... E04B 9/006 362/150

(Continued)

*Primary Examiner* — Rodney Mintz

(74) *Attorney, Agent, or Firm* — Steve Witters; Witters & Associates

(57) ABSTRACT

Technologies are described for a lighting system configured to be mounted with a ceiling support grid and a method of installation. The lighting system has a rectangular or square LED light panel configured to be hung below the ceiling support grid and transform its outer perimeter from a first outer perimeter to a second outer perimeter, enabling it to be inserted into a ceiling grid and to be held therein. The method of installing an LED light panel in a ceiling support grid comprises hanging the LED light panel below the ceiling support grid.

20 Claims, 7 Drawing Sheets

(56) References Cited

U.S. PATENT DOCUMENTS 4,041,657 A * 8/1977 Schuplin ..... E04B 9/006 248/343
4,171,535 A * 10/1979 Westermann ..... F21S 8/02 362/148
4,188,656 A * 2/1980 Howard ..... E04B 9/006 362/365
4,424,554 A * 1/1984 Woloski ..... E04B 9/006 362/150
4,497,014 A * 1/1985 Woloski ..... F21V 21/04 362/150
4,613,929 A * 9/1986 Totten ..... F21S 8/02 362/148
4,967,324 A * 10/1990 Barclay ..... F21V 17/107 362/147
5,044,103 A * 9/1991 Izenberg ..... G09F 7/18 40/611.06
5,428,930 A * 7/1995 Bagley ..... E04B 9/003 52/483.1
5,564,815 A * 10/1996 Littman ..... F21S 8/028 362/147
5,997,158 A * 12/1999 Fischer ..... F21S 8/04 362/364
6,059,424 A * 5/2000 Kotloff ..... F21V 17/107 362/220
6,231,213 B1 * 5/2001 Schmidt ..... F21S 8/02 362/374
7,413,323 B2 * 8/2008 Lippis ..... E04L 39/0478 362/147
7,611,257 B2 * 11/2009 Engel ..... F21V 17/107 362/147
8,042,977 B1 * 10/2011 Nourishad ..... F21S 2/005 362/217.05
8,083,369 B1 * 12/2011 Richardson ..... F21S 8/026 362/217.11
8,272,763 B1 * 9/2012 Chinnam ..... F21V 29/004 362/147
8,393,765 B2 * 3/2013 Sugishita ..... F21S 8/026 362/147
8,556,453 B1 * 10/2013 Crane ..... F21S 8/026 362/217.01
8,764,216 B2 * 7/2014 Caferro ..... F21V 29/004 362/148
8,783,896 B2 * 7/2014 Tirrell ..... E04B 9/006 362/220
8,888,313 B2 * 11/2014 Green ..... F21V 17/18 362/217.11
8,894,232 B2 * 11/2014 Caferro ..... F21V 29/004 362/148
9,206,948 B1 * 12/2015 Scribante ..... F21V 21/03
9,279,553 B1 * 3/2016 Scribante ..... F21S 8/026
9,353,923 B2 * 5/2016 Scribante ..... F21S 8/022
9,488,348 B2 * 11/2016 Scribante ..... F21S 8/026
9,494,286 B2 * 11/2016 Green ..... F21V 17/18
9,551,482 B2 * 1/2017 Seward ..... F21V 17/18
9,671,095 B1 * 6/2017 Sorensen ..... F21V 21/042
9,803,815 B2 * 10/2017 Cousin ..... F21S 8/043
9,835,307 B1 * 12/2017 Blair ..... F21V 3/02
9,845,927 B2 * 12/2017 Sorensen ..... F21S 8/026
9,897,288 B2 * 2/2018 Sorensen ..... F21V 11/02
9,989,225 B2 * 6/2018 Rao ..... E04B 9/003
10,012,352 B2 * 7/2018 Scribante ..... F21V 21/03
10,036,514 B2 * 7/2018 Scribante ..... F21V 21/03
10,094,108 B2 * 10/2018 Murao ..... E04B 9/067
2004/0118068 A1 * 6/2004 Kliegle ..... E04B 9/003 52/483.1
2009/0139155 A1 * 6/2009 Kelders ..... A01M 1/145 52/101
2009/0196024 A1 * 8/2009 Heiking ..... F21S 8/026 362/150
2010/0142202 A1 * 6/2010 Sugishita ..... F21S 8/026 362/235
2011/0103042 A1 * 5/2011 Tirrell ..... E04B 9/006 362/147
2012/0023853 A1 * 2/2012 Gerkes ..... E04L 39/0428 52/506.06
2013/0027915 A1 * 1/2013 Caferro ..... F21V 29/004 362/147
2013/0027916 A1 * 1/2013 Caferro ..... F21V 29/004 362/147
2013/0223100 A1 * 8/2013 Caferro ..... F21V 29/004 362/612
2013/0235568 A1 * 9/2013 Green ..... F21V 17/18 362/218
2014/0146542 A1 * 5/2014 Seward ..... F21V 17/18 362/297
2014/0340883 A1 * 11/2014 Green ..... F21V 17/18 362/220
2015/0267873 A1 * 9/2015 Price ..... F21V 21/03 362/235
2015/0276125 A1 * 10/2015 Pratt ..... F21S 2/005 362/217.15
2015/0345139 A1 * 12/2015 Underkofler ..... E04B 9/003 52/506.08
2016/0084447 A1 * 3/2016 Scribante ..... F21V 21/03 362/223
2016/0091158 A1 * 3/2016 Scribante ..... F21S 8/026 362/223
2016/0091181 A1 * 3/2016 Scribante ..... F21S 8/026 362/220
2016/0102825 A1 * 4/2016 Scribante ..... F21S 8/022 362/217.12
2016/0116136 A1 * 4/2016 Bernard ..... F21V 15/01 362/150
2016/0281941 A1 * 9/2016 Cousin ..... E04B 9/0478
2016/0356430 A1 * 12/2016 Stratas ..... F21S 8/04
2016/0356432 A1 * 12/2016 Scribante ..... F21V 21/03
2016/0377238 A1 * 12/2016 Scribante ..... F21V 21/03 362/223
2017/0038044 A1 * 2/2017 Matsuda ..... F21S 8/061
2017/0051900 A1 * 2/2017 Scribante ..... F21S 8/026
2017/0059101 A1 * 3/2017 Green ..... F21V 17/18
2017/0114970 A1 * 4/2017 Scribante ..... F21S 8/026
2017/0130938 A1 * 5/2017 Seward ..... F21V 17/002
2017/0205036 A1 * 7/2017 Sorensen ..... F21S 8/026
2017/0356625 A1 * 12/2017 Sorensen ..... F21V 11/02
2017/0356632 A1 * 12/2017 Rao ..... E04B 9/003
2018/0010746 A1 * 1/2018 Li ..... F21S 8/026
2018/0017218 A1 * 1/2018 Ham ..... F21K 9/278
2018/0080621 A1 * 3/2018 Blair ..... F21V 23/003
2018/0149319 A1 * 5/2018 Price ..... F21K 9/275
2018/0163398 A1 * 6/2018 Murao ..... E04B 1/98

* cited by examiner

LED LIGHT PANEL AND METHOD OF INSTALLATION

CROSS-REFERENCE TO RELATED APPLICATIONS

This application is a continuation in part of co-pending U.S. patent application Ser. No. 15/368,541, filed Dec. 22, 2016, which is hereby incorporated herein by reference in its entirety.

FIELD OF THE DISCLOSURE

This invention generally relates to an LED light panel and method of installation.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ceiling support grids and ceiling panels are very common in the office buildings where ceilings are constructed over open floor plan interior designs, such as cubicles. Such ceiling are popular in other commercial, industrial and domestic environments, including and not limited to hotels, meeting rooms, recreation rooms and other types of rooms or constructions which require removable ceilings for access to utilities (heating, air conditioning, water) that are concealed in the space between the drop ceiling tiles and the structural ceiling of the room. Such ceiling systems are well suited for use in old office buildings with high ceilings and with ceilings that are curved or arched. Typically, ceiling panels may be installed from beneath the ceiling support grid.

Typical luminaires installed in ceiling support grids may have a troffer with one or more tube lamps held therein. The luminaire may be placed on the ceiling support grid to have the light from the lamps directed downward through a space in the ceiling support grid having a ceiling panel removed. A lens, such as a diffusing lens or diffuser, or louver may be placed about the light opening in the ceiling support grid.

It is often desired to place, replace, or retrofit light sources on a ceiling support grid.

SUMMARY

In at least one embodiment of the present disclosure, a method of installing an LED light panel in a ceiling support grid is provided. The method comprises the steps of: attaching a hook to the ceiling grid or above the ceiling grid; suspending the LED light panel below the ceiling grid with the attached hook; electrically connecting the LED light panel to a power source; placing a first edge of the LED light panel within a plane of the ceiling support grid; laying at least one fixed flat extension, extending outward from the first edge of the LED light panel, on the ceiling support grid; raising a second edge of the LED light panel, opposite the first edge of the LED light panel, and placing the LED light panel within a plane of the ceiling support grid; and extending at least one retractable support, from a retracted position, and laying the at least one extended retractable support on the ceiling support grid.

In at least one other embodiment of the present disclosure, an LED light panel configured for installing in a ceiling support grid is provided. The ceiling support grid comprises at least one rectangular or square grid opening with a first flange extending inward from a first side and a second flange extending inward from a second side, wherein the first flange and the second flange extend inward from a terminal longitudinally extending end of the ceiling support grid. The LED light panel comprises at least one hook extending therefrom configured for suspending the LED light panel below the ceiling grid; a rectangular or square perimeter having a first edge and a second edge, wherein the first edge and the second edge are parallel with one another; at least one fixed flat extension extending from the first edge and in a plane parallel with a plane of the LED light panel, each of the at least one fixed flat extension is configured and disposed to lay on the first flange of the ceiling support grid and removably hold the first edge with the ceiling support grid; wherein each of the at least one fixed flat extension has a first width adjacent the first edge and a second width proximate its extended end, the second width not exceeding the first width; at least one retractable support configured to have a portion extended from the second edge and in a plane parallel with the plane of the LED light panel; wherein the at least one retractable support is configured for passing the LED light panel into the ceiling support grid, through the at least one rectangular or square grid opening, upon the at least one fixed flat extension being laid on the first flange of the ceiling support grid and the at least one retractable support being in the retracted position; and wherein the at least one retractable support is configured for holding the LED light panel with the ceiling support grid upon the at least one fixed flat extension being laid on the first flange of the ceiling support grid and the at least one retractable support being in the extended position and laid on the second flange of the ceiling support grid.

In at least one additional embodiment of the present disclosure, a method of retrofitting a troffer light in a ceiling support grid is provided. The method comprises the steps of: attaching at least one hook to the troffer; suspending an LED light panel below the ceiling grid with the attached hook; electrically connecting the LED light panel to a power source; placing a first edge of the LED light panel within a plane of the ceiling support grid; inserting at least one fixed flat extension, extending outward from the first edge of the LED light panel, between the ceiling support grid and the troffer; raising a second edge of the LED light panel, opposite the first edge of the LED light panel, and placing the LED light panel within a plane of the ceiling support grid; and extending at least one retractable support, from a retracted position, outward between the troffer and ceiling support grid and laying the at least one extended retractable support on the ceiling support grid.

In at least one further embodiment of the present disclosure, a method of installing an LED light panel in a ceiling support grid is provided. The method comprises attaching a hook to the ceiling grid or above the ceiling grid; suspending the LED light panel below the ceiling grid with the attached hook; electrically connecting the LED light panel to a power source; placing a first edge of the LED light panel within a plane of the ceiling support grid; raising a second edge of the LED light panel, opposite the first edge of the LED light panel, and placing the LED light panel within a plane of the ceiling support grid; and extending at least one retractable support, from a retracted position, and laying the at least one extended retractable support on the ceiling support grid.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements are depicted by like reference numerals. The drawings are briefly described as follows:

Figure 1:
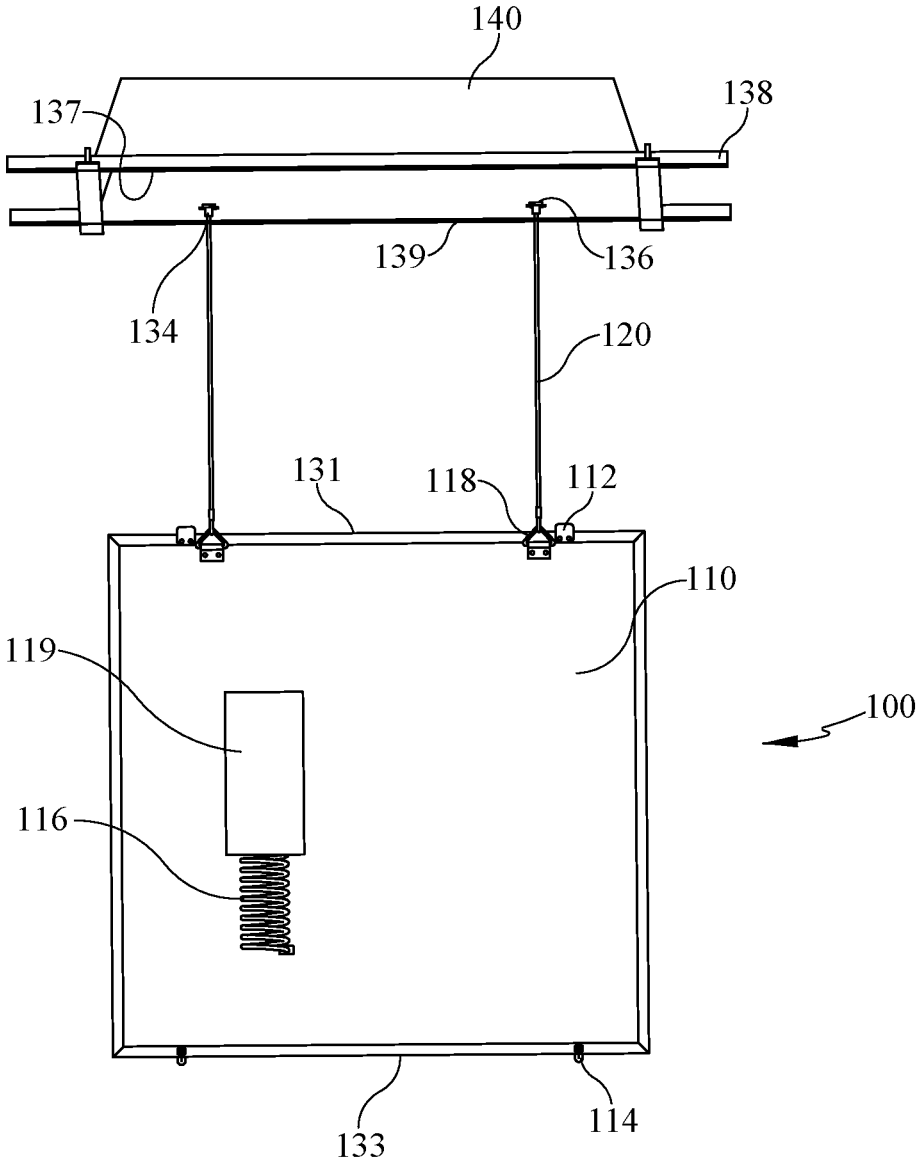
FIG. 1 is a perspective view of an LED light panel of the present disclosure being mounted with a ceiling grid.
Figure 4:
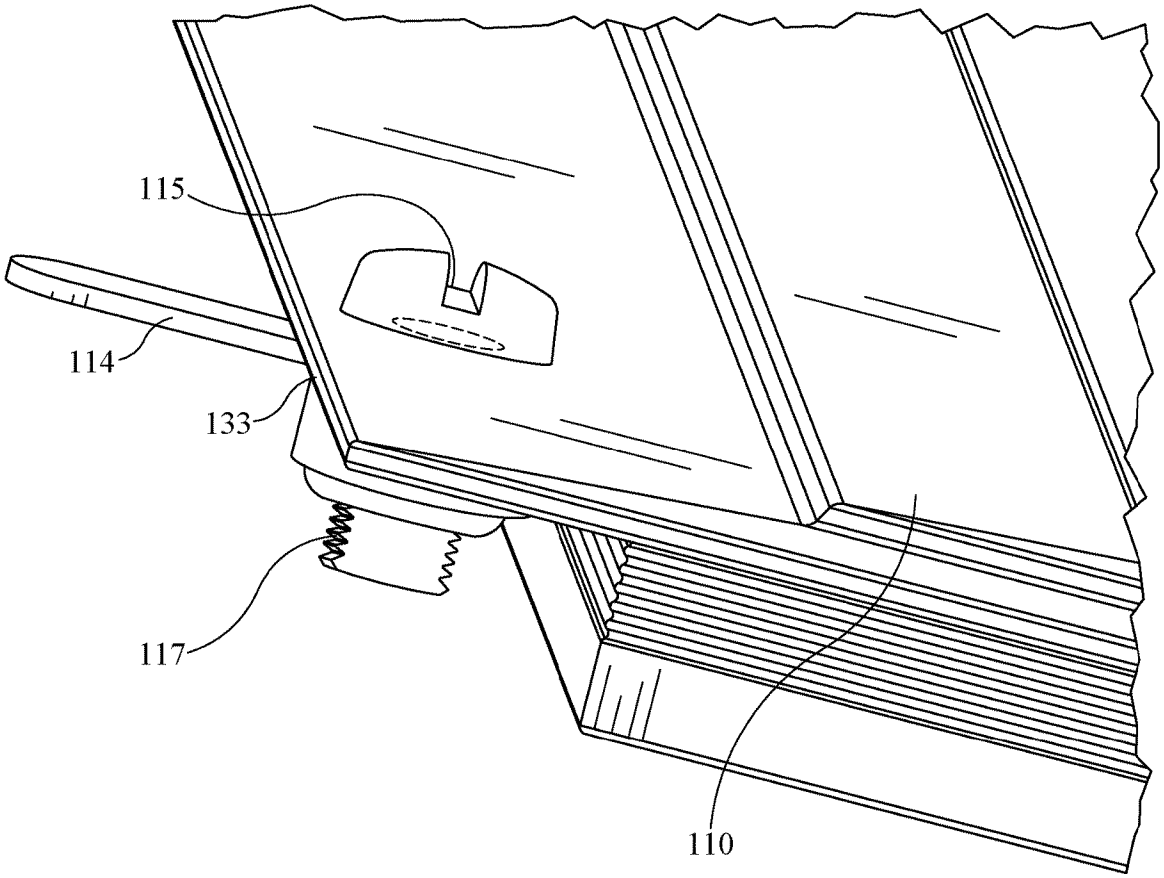
Figure 5:
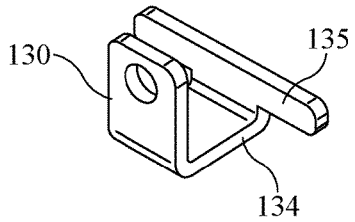
Figure 6:
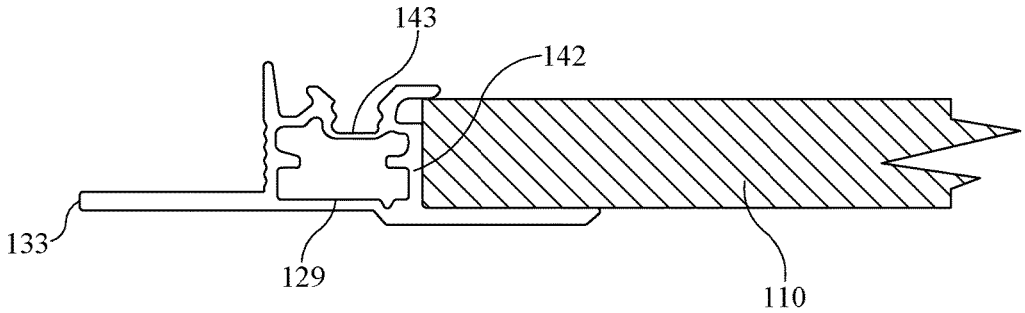
Figure 7:
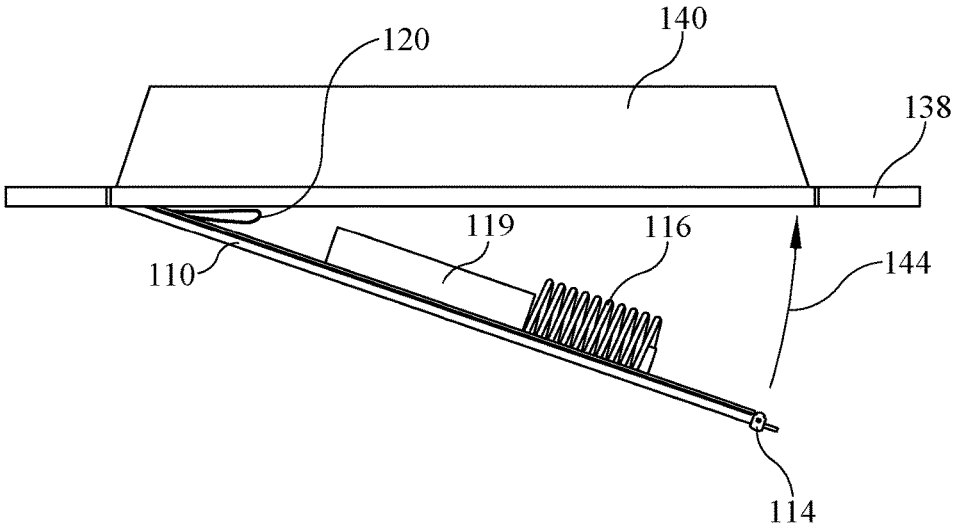
Figure 8:
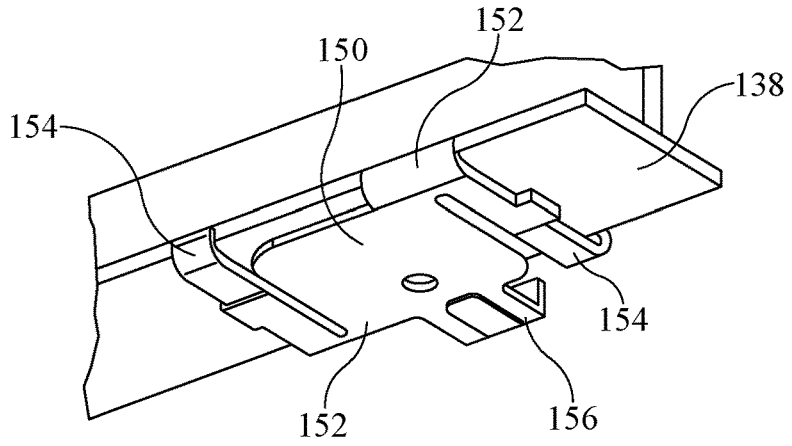
Figure 9:
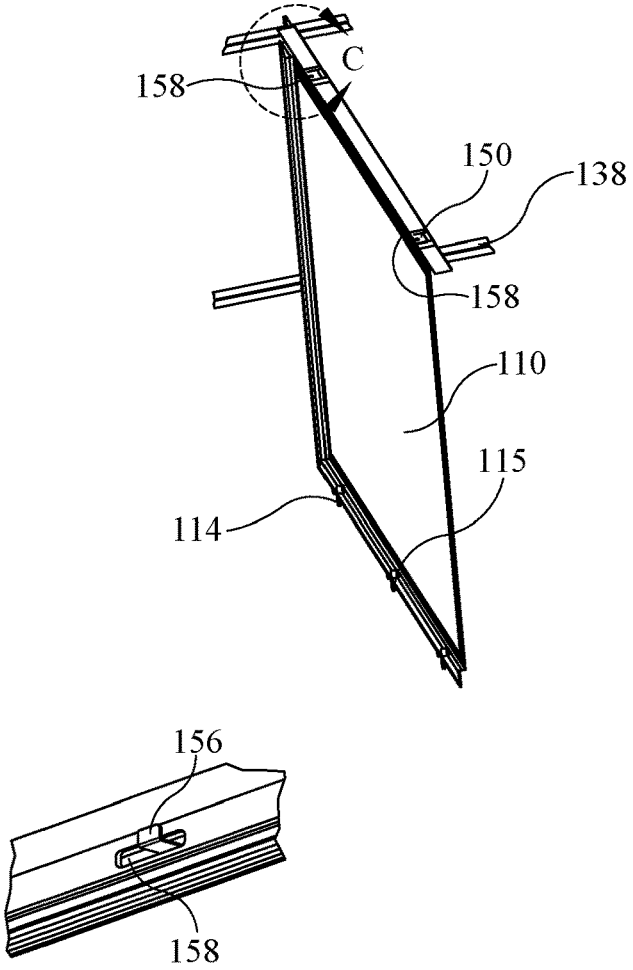

FIG. 4 a cut-away view of the LED light panel shown in FIG. 1, showing an illustrative example of a retractable support extending from an edge of the LED light panel;

FIG. 5 is a perspective view of an illustrative example of a hook;

FIG. 6 is a cross-sectional view of an illustrative frame;

FIG. 7 shows a method of installation of the LED light panel shown in FIG. 1;

FIG. 8 is a perspective view of a clip mounted onto a ceiling support grid; and FIG. 9 shows an LED light panel being mounted to a ceiling grid with the clip shown in FIG. 8.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This present disclosure may provide improvement to existing ceiling support grid lighting systems. Embodiments of the present disclosure may provide a light source that enables easy, or less laborious, installation, or retrofitting, of a light source. The LED light panel of the present disclosure may be installed by hanging from a ceiling support grid, or from something above the ceiling support grid, such as the structure or a troffer light being retrofitted, wiring the LED light panel to a power source, and holding the LED light panel below the ceiling support grid.

An LED light panel of the present disclosure may have an array of LEDs held and electrically connected on a substrate. A polarizing film, light guide, diffuser, lens, and/or cover may be held on a light emitting side of the substrate. A reflective material or reflective plate may also be used to direct light emitting from the LEDs. A support material may be applied to the non-emitting light side of the substrate and a frame may form a perimeter of the LED light panel.

For example, a frame may cover the outer edges of the substrate and may be configured to provide protection and thermal conductivity of the LEDs or substrate. In an illustrative embodiment, a frame is made of extruded aluminum, which may provide heat dissipation. However, a frame may not be required or may comprise polymeric materials, such as PVC.

The LED light panel of the present disclosure may be suspended or hung from the ceiling support grid, a portion of the structure above the ceiling support grid, or a luminaire, for example a troffer, installed in the ceiling support grid. In at least one embodiment, the LED light panel is configured for retrofitting an existing troffer.

In an illustrative embodiment, the LED light panel has at least one hook configured to attach to a ceiling support grid, a portion of the structure above the ceiling support grid, or a luminaire installed in the ceiling grid. The hook may have a cord extending therefrom and the cord may be attached the LED light panel. The hook and cord may have a length sufficient to suspend the LED light panel a desired distance from the ceiling support grid to provide sufficient room to electrically connect the LED light panel to a power source. For example, the hook and cord may provide a distance of at least about a foot, to allow access to the power source, such as existing wiring, and electrically connect the LED light panel to the power source. In at least one embodiment, the LED light panel has a hook and cord for providing a distance between about 10 inches and 3 feet, in one inch increments, between the LED light panel and the ceiling support grid. For example, the LED light panel may be configured to be suspended, or hung, about two feet from the ceiling support grid.

Additionally, the hook and cord may provide for alternative attachment locations for hanging the LED light panel to the ceiling support grid, portions of the structure above the ceiling support grid, and/or a luminaire being retrofitted. For example, the cord(s) may provide alternative spacing between hooks that may enable hanging the LED light panel from a variety of spaced structural components above a grid opening. In at least one embodiment, the LED light panel of the present disclosure may be hung below different troffers having differently spaced slots or other features that may provide hooking locations.

Upon hanging the LED light panel below the ceiling support grid, the LED light panel may be electrically connected to a power source. For example, the LED light panel may have a driver mounted on an upper, non-light emitting side, and a coiled wire extending from the driver. The coiled wire may be attached to a power source by uncoiling and connecting it to a power source, for example, the wire may be electrically connected to existing wires in the structure or to wiring in an existing luminaire being retrofitted, such as a troffer.

Upon electrically connecting the LED light panel, the LED light panel may be raised and held with the ceiling support grid. For example, one edge of the LED light panel may have fixed flat extension(s) configured to cooperate with, or lay on, the ceiling support grid and the opposite edge may have retractable supports configured to cooperate with, or lay on, the ceiling support grid, upon extending the retractable supports.

The LED light panel may have a low profile, enabling it fit into an existing troffer for retrofitting. For example, the LED light panel may be in the form of a planar panel with a driver mounted on its non-light emitting side, wherein the driver is configured and disposed to fit in the troffer or housing of the luminaire being retrofitted.

Figure 2:
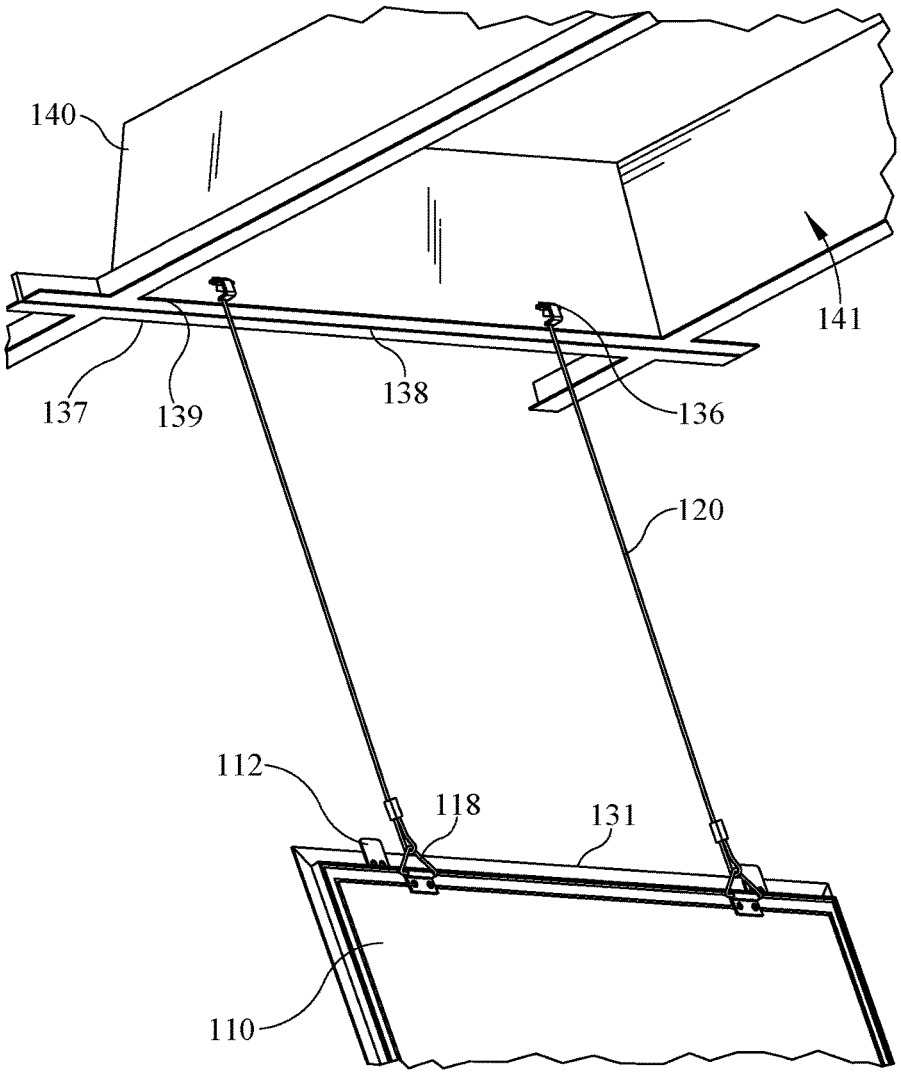
FIG. 2 is a cut-away view of the LED light panel shown in FIG. 1, showing an illustrative example of a hook in cooperation with a troffer being retrofitted.

FIG. 1 is a perspective view of an illustrative example of the presently disclosed LED lighting system 100 having LED light panel 110, hanging from a ceiling support grid 138. FIG. 2 shows a cut-away portion of LED light panel 110, ceiling support grid 138, and troffer 140 being retrofitted. With reference to FIGS. 1 and 2, LED light panel 110 is shown configured for installing in ceiling support grid 138. Ceiling support grid 138 comprises at least one rectangular or square grid opening 141. Ceiling support grid 138 may have a "T" cross-sectional configuration with a first flange 139 extending inward from a first side and a second flange 137 extending inward from a second side, wherein first flange 139 and second flange 137 extend inward from a lower terminal longitudinally extending end of ceiling support grid 138.

LED light panel 110 has at least one hook 134 extending therefrom, configured for suspending LED light panel 110 below the ceiling grid 138. LED light panel 110 has a rectangular or square perimeter with a first edge 131 and a second edge 133, wherein first edge 131 and the second edge 133 are parallel with one another.

At least one fixed flat extension 112 extends from first edge 131 and in a plane parallel with a plane of LED light panel 110. Each of the at least one fixed flat extension 112 is configured and disposed to lay on first flange 139 of ceiling support grid 138 and removably hold first edge 131 with ceiling support grid 138. Each of the at least one fixed flat extensions may have a first width adjacent first edge 131 and a second width proximate its extended end, the second width not exceeding the first width. For example, fixed flat extensions 112 may be rectangular, square, angular, or rounded.

At least one retractable support 114 may be configured to have a portion extended from second edge 133 and in a plane parallel with the plane of LED light panel 110. Retractable support 114 may be configured for passing the LED light panel into ceiling support grid 138, through the at least one rectangular or square grid opening 141, upon at least one fixed flat extension 112 being laid on first flange 139 of ceiling support grid 138 and retractable support 114 being in the retracted position. Retractable support 114 may be configured for holding LED light panel 110 with ceiling support grid 138 upon fixed flat extension 112 being laid on first flange 139 of ceiling support grid 138 and retractable support 114 being in the extended position and laid on second flange 137 of ceiling support grid 138.

LED light panel 110 may have a hanging cord 120 extending from each hook 134 and attaching hook 134 to LED light panel 110. Hanging cord 120 is configured to suspend LED light panel 110 from the ceiling support grid 138 a distance sufficient for electrically connecting LED light panel 110 to a power source. Hanging cord 120 may be configured to suspend LED light panel 110 at least 10 inches below ceiling support grid 138.

LED light panel 110 may have at least one retractable support 114 having a retractable support arm configured to be rotated into and out of an extended position. The at least one retractable support 114 may have an extending portion, or arm, inserted between troffer 140 and second flange 137 of ceiling support grid 138. The at least one fixed flat extension 112 may be configured to have an extending portion inserted between troffer 140 and first flange 139 of ceiling support grid 138. Troffer 140 may rest on at least one fixed flat extension 112 and at least one retractable support 114.

FIG. 2 shows a cut-away view of LED light panel 110 and troffer 140 being retrofitted with lighting system 100. Hook 134 is shown in cooperation with slot 136, in troffer 140. In an illustrative example, slot 136 is a "T" shaped slot and hook 134 has a "T" shaped end. In this example, the wide end of hook 134 fits into the wide end of slot 136 and is held in the narrow end of slot 136. Upon hanging LED light panel 110 to troffer 140, coiled wire 116 may be electrically connected to a power source.

Figure 3:
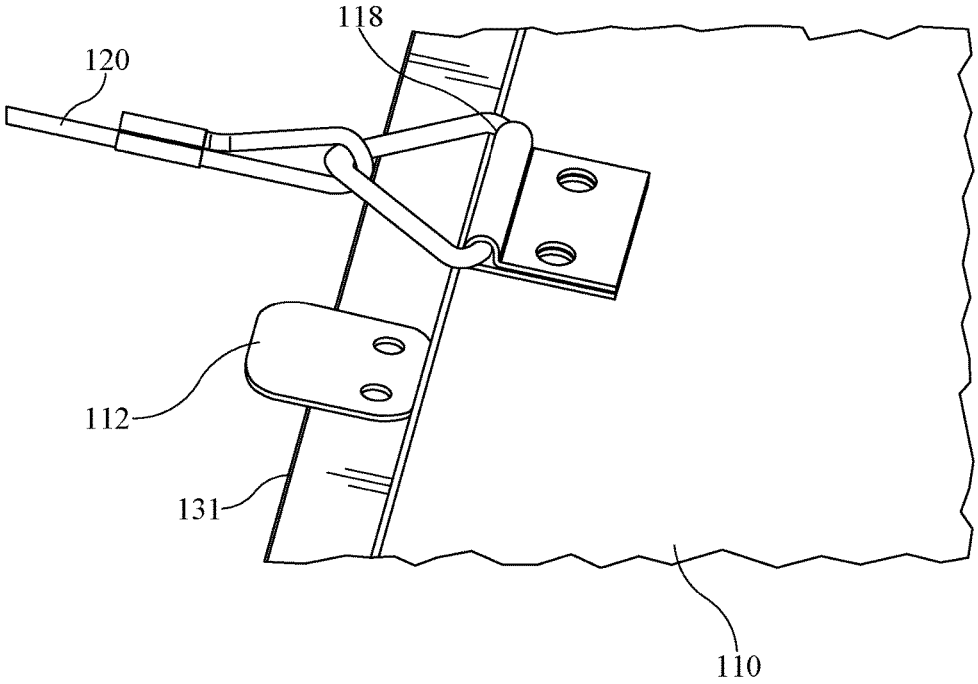
FIG. 3 is a cut-away view of the LED light panel shown in FIG. 1, showing an illustrative example of a cord and a fixed flat extension, extending from an edge of the LED light panel.

FIG. 3 is a cut-away view of LED light panel 110 showing an illustrative example of cord 120 and fixed flat extension 112, extending from first edge 131 of LED light panel 110. Cord 120 may be hingedly attached to light panel 110. In at least one embodiment, hinge 118 is attached to LED light panel 110 and cord 120 is attached to hinge 118. At least one fixed flat extension 112 extends from first edge 131 of LED light panel 110. Fixed flat extension 112 may have has a first width adjacent first edge 131 and a second width proximate its extended end, the second width not exceeding the first width. For example, fixed flat extensions 112 may be rectangular, square, angular, or rounded. Fixed flat extension 112 may be configured to be inserted between a troffer and the ceiling support grid and have the troffer rest on the at least one fixed flat extension 112. Hinge 118 and fixed flat extension 112 may have planar portions for mounting onto LED light panel 110. The planar portions may have one or more apertures for receiving a fastener for fastening onto LED light panel 110.

FIG. 4 a cut-away view of the LED light panel 110 showing an illustrative example of a retractable support 114 extending from edge 133. Retractable support 114 may be fastened to LED light panel 110 with fastener 117 and configured to be extended and retracted from the non-light emitting side of LED light panel 110. In at least one illustrative example, retractable support 114 comprises a slot 115 configured for rotating retractable support 114 into a retracted and extended position.

FIG. 5 is a perspective view of an illustrative hook 134. Hook 134 may have a "U" configuration with a first end 130 configured for attaching with hanging cord 120. For example, first end 130 may have an aperture for attaching with hanging cord 120. A second end 135 of hook 134 may be configured for hooking with ceiling support grid 138, something above the ceiling support grid, such as the structure, or a troffer being retrofitted. For example, second end 135 may have a widened end of a "T" configuration configured to be inserted, and held with, a "T" slot, such as slot 136 in troffer 140.

The edges of the LED light panel 110 may have lengths of material, such as metallic or polymeric, cut and attached around a light emitting portion of LED light panel 110. The edges of the lengths may form the perimeter of LED light panel 110 and may be configured to be inserted into ceiling grid opening and held therein.

FIG. 6 is a cross-sectional view of extruded lengths 129. Extruded lengths 129 may extend around a perimeter of LED panel light 110. A first side 142 may be configured to fit around LED light panel 110. In at least one embodiment, first side 142 has a portion extending onto both the light emitting side and the non-light emitting side of LED panel light 110. A second side of extruded lengths 129 may define the edges of LED panel light 110, for example second edge 133. A portion of extruded lengths 129 may extend out to the edges and hold fixed flat extensions 112 and retractable supports 114. A central portion 143 may have a cross-sectional configuration providing sufficient support for holding LED panel light to ceiling support grid 138, with fixed flat extensions 112 and retractable supports 114.

FIG. 7 illustratively shows a method of installation of an LED light panel. A method of installing an LED light panel in a ceiling support grid may comprise attaching a hook to the ceiling grid, or above the ceiling grid, and suspending the LED light panel below the ceiling grid with the attached hook. The LED light panel may then be electrically connected to a power source. Electrically connecting the LED light panel to a power source may be performed by uncoiling a coiled wire and attaching the uncoiled wire to a power source. A first edge of the LED light panel may be placed within a plane of the ceiling support grid and at least one fixed flat extension, extending outward from the first edge of the LED light panel, may be laid on the ceiling support grid. A second edge of the LED light panel, opposite the first edge of the LED light panel, may be raised and the LED light panel may be placed within a plane of the ceiling support grid. At least one retractable support may be extended, from a retracted position, and laid on the ceiling support grid.

FIGS. 8 and 9 show clip 150 mounted onto ceiling support grid 138 and LED light panel 110 being mounted to ceiling grid 138, with the clip 150. Clip 150 may be configured to snap onto ceiling support grid 138. For example, clip 150 may have legs 152 and springing legs 154, wherein legs 152 and springing legs 154 are configured and disposed to spread apart and receive ceiling support grid 138 therebetween, as shown in FIG. 8. Once the clips have been attached to ceiling support grid 138, they may be moved, or slid, on ceiling support grid 138 to position hooks 156 at desired positions. Slots 158, in LED light panel 110, may then receive hooks 156 and LED light panel 110 may be hung from ceiling support grid 138, as shown in FIG. 9. Upon hanging LED light panel 110 from ceiling support grid 138, with clips 150, LED light panel 110 may be electrically connected to a power source. LED light panel 110 may then be rotated about hooks 156 and positioned within a plane of ceiling support grid 138. Retractable supports 114 may then be extended, with rotation at slot 115, for example, to cooperate with ceiling support grid 138 and hold LED light panel 110 to ceiling support grid 138.

An existing luminaire held in the ceiling support grid may be retrofitted with the presently disclosed method. For example, at least one fixed flat extension may be inserted between a troffer and the ceiling support grid and at least one retractable support between the troffer and the ceiling support grid. In at least one embodiment, the extending of at least one retractable support comprises rotating a retractable support from a retracted position and into an extended position. The attaching of a hook to the ceiling grid or above the ceiling grid may comprise attaching the hook to the troffer. For example, a hook may be inserted into a slot in the troffer.

The LED light panel may be suspended below the ceiling grid with a cable extending between the LED light panel and a hook attached to the ceiling grid or above the ceiling grid. The LED light panel may be suspended at least 10 inches below the ceiling support grid.

For example, LED light panel 110 may have holders in the form of flat fixed extensions that may be laid on a flange of the grid. These holders may be inserted between the flange and an existing installed troffer for retrofitting the existing troffer luminaire. The opposite, or parallel, edge of the LED light panel may then be placed into the ceiling grid and a retractable support may be extended to cooperate with, or lay on, the opposite side flange of the ceiling support grid.

LED light panel 110 may have a rectangular or square mounting perimeter or frame configured to transform its outer perimeter from a first outer perimeter to a second outer perimeter. The first outer perimeter has at least one fixed flat extension 112 and enables LED light panel 110 to fit into ceiling support grid 138 and have at least one fixed flat extension cooperate with, or lay on, the first longitudinal flange 139. The second outer perimeter enables LED light panel 110 to cooperate with second longitudinal flange 137 and to be held with the ceiling support grid 138. For example, retraction of retractable support 114 configures LED light panel 110 with the first outer perimeter and to fit into ceiling support grid 138.

The extension of the at least one retractable supports 114 configures LED light panel 110 with the second outer perimeter. A portion of retractable support 114 extends outward and cooperates with, or lies on, support grid 138. For example, retractable support may be extended outward to lie on flange 137, of support grid 138.

There is thus provided a lighting system having an LED light panel and a method of installing a lighting system in a ceiling support grid. One feature or aspect of an illustrative example is believed at the time of the filing of this patent application to possibly reside broadly in a method of installing an LED light panel in a ceiling support grid comprising the steps of: attaching a hook to the ceiling grid or above the ceiling grid; suspending the LED light panel below the ceiling grid with the attached hook; electrically connecting the LED light panel to a power source; placing a first edge of the LED light panel within a plane of the ceiling support grid; laying at least one fixed flat extension, extending outward from the first edge of the LED light panel, on the ceiling support grid; raising a second edge of the LED light panel, opposite the first edge of the LED light panel, and placing the LED light panel within a plane of the ceiling support grid; and extending at least one retractable support, from a retracted position, and laying the at least one extended retractable support on the ceiling support grid.

Another feature or aspect of an illustrative example is believed at the time of the filing of this patent application to possibly reside broadly in the method of installing an LED light panel in a ceiling support grid, wherein the step of electrically connecting the LED light panel to a power source comprises uncoiling a coiled wire and attaching the uncoiled wire to a power source.

Still another feature or aspect of an illustrative example is believed at the time of the filing of this patent application to possibly reside broadly in the method of installing an LED light panel in a ceiling support grid, wherein the step of laying at least one fixed flat extension on the ceiling support grid comprises inserting the at least one fixed flat extension between a troffer and the ceiling support grid and the step of extending at least one retractable support and laying the at least one extended retractable support on the ceiling support grid comprises inserting the at least one retractable support between the troffer and the ceiling support grid.

A further feature or aspect of an illustrative example is believed at the time of the filing of this patent application to possibly reside broadly in the method of installing an LED light panel in a ceiling support grid, wherein the step of extending at least one retractable support comprises rotating a retractable support.

Another feature or aspect of an illustrative example is believed at the time of the filing of this patent application to possibly reside broadly in the method of installing an LED light panel in a ceiling support grid, wherein the step of attaching a hook to the ceiling grid or above the ceiling grid comprises attaching the hook to the troffer.

A further feature or aspect of an illustrative example is believed at the time of the filing of this patent application to possibly reside broadly in the method of installing an LED light panel in a ceiling support grid, wherein the step of attaching a hook to the troffer comprises inserting the hook into a slot in the troffer.

Yet another feature or aspect of an illustrative example is believed at the time of the filing of this patent application to possibly reside broadly in the method of installing an LED light panel in a ceiling support grid, wherein the step of suspending the LED light panel below the ceiling grid with the attached hook comprises suspending the LED light panel with a cable extending between the LED light panel and the hook.

Still another feature or aspect of an illustrative example is believed at the time of the filing of this patent application to possibly reside broadly in the method of installing an LED light panel in a ceiling support grid, wherein the step of suspending the LED light panel with a cable extending between the LED light panel and the hook comprises suspending the LED light panel at least 10 inches below the ceiling support grid.

Another feature or aspect of an illustrative example is believed at the time of the filing of this patent application to possibly reside broadly in an LED light panel configured for installing in a ceiling support grid; the ceiling support grid comprising at least one rectangular or square grid opening with a first flange extending inward from a first side and a second flange extending inward from a second side, wherein the first flange and the second flange extend inward from a terminal longitudinally extending end of the ceiling support grid; the LED light panel comprising: at least one hook extending from the LED light panel configured for suspending the LED light panel below the ceiling grid; a rectangular or square perimeter having a first edge and a second edge, wherein the first edge and the second edge are parallel with one another; at least one fixed flat extension extending from the first edge and in a plane parallel with a plane of the LED light panel, each of the at least one fixed flat extension is configured and disposed to lay on the first flange of the ceiling support grid and removably hold the first edge with the ceiling support grid; wherein each of the at least one fixed flat extension has a first width adjacent the first edge and a second width proximate its extended end, the second width not exceeding the first width; at least one retractable support configured to have a portion extended from the second edge and in a plane parallel with the plane of the LED light panel; wherein the at least one retractable support is configured for passing the LED light panel into the ceiling support grid, through the at least one rectangular or square grid opening, upon the at least one fixed flat extension being laid on the first flange of the ceiling support grid and the at least one retractable support being in the retracted position; and wherein the at least one retractable support is configured for holding the LED light panel with the ceiling support grid upon the at least one fixed flat extension being laid on the first flange of the ceiling support grid and the at least one retractable support being in the extended position and laid on the second flange of the ceiling support grid.

Yet another feature or aspect of an illustrative example is believed at the time of the filing of this patent application to possibly reside broadly in the LED light panel comprising a cord extending from each of the at least one hooks and attaching the hook to the LED light panel.

One feature or aspect of an illustrative example is believed at the time of the filing of this patent application to possibly reside broadly the LED light panel, wherein the cord is configured to suspend the LED light panel from the ceiling support grid a distance sufficient for electrically connecting the LED light panel to a power source.

Another feature or aspect of an illustrative example is believed at the time of the filing of this patent application to possibly reside broadly in the LED light panel, wherein the cord is configured to suspend the LED light panel at least 10 inches from the ceiling support grid.

Yet another feature or aspect of an illustrative example is believed at the time of the filing of this patent application to possibly reside broadly in the LED light panel, wherein the at least one retractable support comprises a retractable support configured to be rotated into and out of the extended position.

Still another feature or aspect of an illustrative example is believed at the time of the filing of this patent application to possibly reside broadly in the LED light panel, wherein the at least one fixed flat extension and the at least one retractable support are configured to be inserted between a troffer and the first and the second flanges of the ceiling support grid and have the troffer rest on the at least one fixed flat extension and the at least one retractable support.

A further feature or aspect of an illustrative example is believed at the time of the filing of this patent application to possibly reside broadly in a method of retrofitting a troffer light in a ceiling support grid comprising the steps of: attaching at least one hook to the troffer; suspending an LED light panel below the ceiling grid with the attached hook; electrically connecting the LED light panel to a power source; placing a first edge of the LED light panel within a plane of the ceiling support grid; inserting at least one fixed flat extension, extending outward from the first edge of the LED light panel, between the ceiling support grid and the troffer; raising a second edge of the LED light panel, opposite the first edge of the LED light panel, and placing the LED light panel within a plane of the ceiling support grid; and extending at least one retractable support, from a retracted position, outward between the troffer and ceiling support grid and laying the at least one extended retractable support on the ceiling support grid.

Another feature or aspect of an illustrative example is believed at the time of the filing of this patent application to possibly reside broadly in the method of installing an LED light panel in a ceiling support grid, wherein the step of electrically connecting the LED light panel to a power source comprises uncoiling a coiled wire and attaching the uncoiled wire to a power source in the troffer.

Yet another feature or aspect of an illustrative example is believed at the time of the filing of this patent application to possibly reside broadly in the method of installing an LED light panel in a ceiling support grid, wherein the step of extending at least one retractable support comprises rotating a retractable support.

Still another feature or aspect of an illustrative example is believed at the time of the filing of this patent application to possibly reside broadly in the method of installing an LED light panel in a ceiling support grid, wherein the step of attaching a hook to the troffer comprises inserting the hook into a slot in the troffer.

A further feature or aspect of an illustrative example is believed at the time of the filing of this patent application to possibly reside broadly in the method of installing an LED light panel in a ceiling support grid, wherein the step of attaching at least one hook to the troffer comprises inserting a hook having a "T" end into a "T" slot in the troffer.

One feature or aspect of an illustrative example is believed at the time of the filing of this patent application to possibly reside broadly in the method of installing an LED light panel in a ceiling support grid, wherein the step of suspending the LED light panel below the ceiling grid with the attached hook comprises suspending the LED light panel at least 10 inches below the troffer with a cable extending between the LED light panel and the hook.

Another feature or aspect of an illustrative example is believed at the time of the filing of this patent application to possibly reside broadly in a method of installing an LED light panel in a ceiling support grid comprising the steps of: attaching a hook to the ceiling grid or above the ceiling grid; suspending the LED light panel below the ceiling grid with the attached hook; electrically connecting the LED light panel to a power source; placing a first edge of the LED light panel within a plane of the ceiling support grid; raising a second edge of the LED light panel, opposite the first edge of the LED light panel, and placing the LED light panel within a plane of the ceiling support grid; and extending at least one retractable support, from a retracted position, and laying the at least one extended retractable support on the ceiling support grid.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

AT LEAST PARTIAL NOMENCLATURE

100 lighting system
110 LED light panel
112 fixed flat extension
114 retractable support
115 slot
116 coiled wire
117 fastener
118 hinge
119 driver
120 hanging cord
121 hinge plate
129 frame
130 hanging cord attachment portion of hook
131 first edge of LED light panel
133 second edge of LED light panel
134 hook
135 outward extension of hook
136 slot
137 second inward extending longitudinal flange of grid
138 ceiling support grid
139 first inward extending longitudinal flange of grid
140 troffer
141 opening in ceiling support grid
150 clip
154 springing leg
152 leg
156 hook

The invention claimed is:

1. A method of installing an LED light panel directly to a ceiling support grid comprising the steps of:

attaching at least one hook directly onto an outer surface of the ceiling support grid having continuously uninterrupted longitudinally extending supports to a troffer;

suspending the LED light panel below the ceiling support grid with the attached at least one hook;

electrically connecting the LED light panel to a power source;

placing a first edge of the LED light panel within a plane of the ceiling support grid and laying at least a portion of the first edge directly on the ceiling support grid;

raising a second edge of the LED light panel, opposite and parallel with the first edge of the LED light panel, and placing the LED light panel within the plane of the ceiling support grid;

extending at least one retractable support, from a retracted position to an extended position, and laying the at least one extended retractable support directly on the ceiling support grid; and resting the LED light panel directly on the ceiling support grid.

2. The method of installing an LED light panel directly to a ceiling support grid of claim 1, wherein the step of electrically connecting the LED light panel to a power source comprises uncoiling a coiled wire and attaching the uncoiled wire to the power source.

3. The method of installing an LED light panel directly to a ceiling support grid of claim 1, wherein the step of extending at least one retractable support comprises rotating the at least one retractable support.

4. The method of installing an LED light panel directly to a ceiling support grid of claim 1, wherein the step of suspending the LED light panel below the ceiling support grid with the attached at least one hook comprises suspending the LED light panel with a cable extending between the LED light panel and the at least one hook.

5. The method of installing an LED light panel directly to a ceiling support grid of claim 4, wherein the step of suspending the LED light panel with a cable extending between the LED light panel and the at least one hook comprises suspending the LED light panel at least 10 inches below the ceiling support grid.

6. The method of installing an LED light panel directly to a ceiling support grid of claim 1 further comprising laying at least one fixed flat extension, extending outward from the first edge of the LED light panel, on the ceiling support grid, upon placing the first edge of the LED light panel within the plane of the ceiling support grid.

7. The method of installing an LED light panel directly to a ceiling support grid of claim 6, wherein the step of laying at least one fixed flat extension on the ceiling support grid comprises inserting the at least one fixed flat extension between the troffer and the ceiling support grid and the step of extending at least one retractable support and laying the at least one extended retractable support on the ceiling support grid comprises inserting the at least one retractable support between the troffer and the ceiling support grid.

8. The method of installing an LED light panel directly to a ceiling support grid of claim 7, wherein the step of attaching at least one hook to the ceiling support grid or to a troffer comprises attaching the at least one hook to the troffer.

9. The method of installing an LED light panel directly to a ceiling support grid of claim 8, wherein the step of attaching at least one hook to the troffer comprises inserting the at least one hook into a slot in the troffer.

10. The method of installing an LED light panel directly to a ceiling support grid of claim 1, wherein the ceiling support grid comprises at least one rectangular or square grid opening with a first flange extending inward from a first side, a second flange extending inward from a second side, and an upward extending flange, wherein the first flange and the second flange extend inward from a terminal longitudinally extending end of the ceiling support grid and the upward extending flange extends upward from the terminal longitudinally extending end of the ceiling support grid;

the at least one hook extends from the LED light panel and is configured for suspending the LED light panel below the ceiling grid;

the at least one retractable support is configured to have a portion extended from the second edge and in a plane parallel with a plane of the LED light panel;

wherein the at least one retractable support is configured for passing the LED light panel into the ceiling support grid, through the at least one rectangular or square grid opening, upon the at least one retractable support being in the retracted position; and wherein the at least one retractable support is configured for holding the LED light panel with the ceiling support grid upon the at least one retractable support being in the extended position and laid on the second flange of the ceiling support grid.

11. The method of installing an LED light panel directly to a ceiling support grid of claim 10, wherein the at least one retractable support is configured to be rotated into and out of the extended position.

12. The method of installing an LED light panel directly to a ceiling support grid claim 10, wherein the first edge has at least one fixed flat extension extending outward therefrom, the at least one fixed flat extension and the at least one retractable support are configured to be inserted between the troffer and the first and the second flanges of the ceiling support grid and have the troffer rest on the at least one fixed flat extension and the at least one retractable support.

13. The method of installing an LED light panel directly to a ceiling support grid of claim 10, wherein the LED light panel comprises a cord extending from each of the at least one hooks and attaching the hook to the LED light panel.

14. The method of installing an LED light panel directly to a ceiling support grid of claim 13, wherein the cord is configured to suspend the LED light panel from the ceiling support grid a distance sufficient for electrically connecting the LED light panel to the power source.

15. The method of installing an LED light panel directly to a ceiling support grid claim 13, wherein the cord is configured to suspend the LED light panel at least 10 inches from the ceiling support grid.

16. The method of installing an LED light panel directly to a ceiling support grid of claim 1, further comprising inserting at least one fixed flat extension, extending outward from the first edge of the LED light panel, between the ceiling support grid and the troffer, and wherein the step of extending at least one retractable support, from a retracted position to an extended position, comprises extending the at least one retractable support outward between the troffer and the ceiling support grid.

17. The method of installing an LED light panel directly to a ceiling support grid of claim 16 wherein the step of electrically connecting the LED light panel to a power source comprises uncoiling a coiled wire and attaching the uncoiled wire to a power source in the troffer.

18. The method of installing an LED light panel directly to a ceiling support grid of claim 16, wherein the step of suspending the LED light panel below the ceiling grid with the attached hook comprises suspending the LED light panel at least 10 inches below the troffer with a cable extending between the LED light panel and the hook.

19. The method of installing an LED light panel directly to a ceiling support grid of claim 16, wherein the step of attaching at least one hook directly onto an outer surface of the ceiling support grid or to a troffer comprises attaching the at least one hook to the troffer.

20. The method of installing an LED light panel directly to a ceiling support grid of claim 19, wherein the step of attaching the at least one hook to the troffer comprises inserting the hook into a slot in the troffer.

* * * * *